United States Patent [19]

Righi

[11] 4,389,205

[45] Jun. 21, 1983

[54] AUTOMATIC MACHINE FOR FORMING PACKAGING CASES

[75] Inventor: Bruno Righi, Bologna, Italy

[73] Assignee: Centro Automazioni Moderne S.p.A., Rastignano, Italy

[21] Appl. No.: 198,735

[22] Filed: Oct. 20, 1980

[30] Foreign Application Priority Data

Oct. 25, 1979 [IT] Italy ..... 3517 A/79

[51] Int. Cl.[3] ..... B31B 1/76

[52] U.S. Cl. ..... 493/315; 493/318

[58] Field of Search ..... 493/315, 318, 319, 313, 493/125, 126

[56] References Cited

U.S. PATENT DOCUMENTS 2,765,715 10/1956 Kerr ..... 493/318

3,030,869 4/1962 Galloway ..... 493/319

3,937,131 2/1976 Kellogg ..... 493/319 X

FOREIGN PATENT DOCUMENTS 756890 9/1956 United Kingdom ..... 493/315

*Primary Examiner*—James F. Coan

*Attorney, Agent, or Firm*—Guido Modiano; Albert Josif

[57] ABSTRACT

A machine for forming packaging cases starting from a tubular flattened condition thereof is described wherein the flattened cases are picked up from a magazine and transferred to gripping suckers which deliver them onto a removal conveyor; during their travel, blade elements, which are moved synchronously with the gripping suckers, penetrate the flattened cases and, by rotating about themselves, spread them open.

4 Claims, 4 Drawing Figures

AUTOMATIC MACHINE FOR FORMING PACKAGING CASES

BACKGROUND OF THE INVENTION

This invention relates to an automatic machine for forming packaging cases.

Known are packaging cases intended for containing a variety of products, such cases being formed from cardboard sheets which are die-cut and folded onto themselves to produce tubular elements having closure flaps at their opposed ends. Such tubular elements, which are stored in a flattened condition and stacked upon one another in a magazine, are subsequently spread open to take a parallelepipedal shape and then closed by folding the end flaps over to define the bottom and cover or lid of the finished case.

Conventional machines for picking up the folded cases from the magazine and spreading them open have operational limitations, in that the atmospheric pressure tends to resist the case spreading action by preventing air from entering the case with sufficient rapidity. This problem becomes the more serious, the larger is the size of the cases being processed, so that to avoid irreversible deformation of the cases and delay at the packaging area, it becomes necessary to reduce the case spreading rate as their sizes increase.

SUMMARY OF THE INVENTION

Accordingly, this invention sets out to provide a machine which is capable of sprading packaging cases open, as picked up in the flattened condition from a magazine, at a high rate and without damaging them.

Within that general aim, it can be arranged that the machine according to the invention has a simple construction, a high degree of reliability, and is easily adapted to accommodate packaging cases of different size.

According to one aspect of this invention, there is provided an automatic machine for forming packaging cases, characterized in that it comprises a magazine intended for containing a stack of packaging cases in a tubular flattened condition thereof, means for picking up individual ones of said cases from said magazine, a conveyor whereon said picked up cases are deposited and having entraining means for advancing the flattened cases, a rotary body provided with at least one peripheral member adapted for engaging an entrained case as moved past by said conveyor and transfer it along a restrained path with said case being held transversally to the direction of advance thereof, at least one blade element supported such as to follow, over a certain distance, the movement of said rotary body in the same plane as the case being transferred, said blade element being pivotable on itself, means of controlling the displacement of said blade element from a first position external to said case to a second position in the inside thereof, means being also provided for rotating said blade element within said case and causing said case to spread open.

BRIEF DESCRIPTION OF THE DRAWINGS

Further advantages and features will be more clearly apparent from the following description of a preferred embodiment of the invention, as illustrated by way of example in the accompanying drawings, where.

DESCRIPTION OF THE PREFERRED EMBODIMENTS

Figure 1:
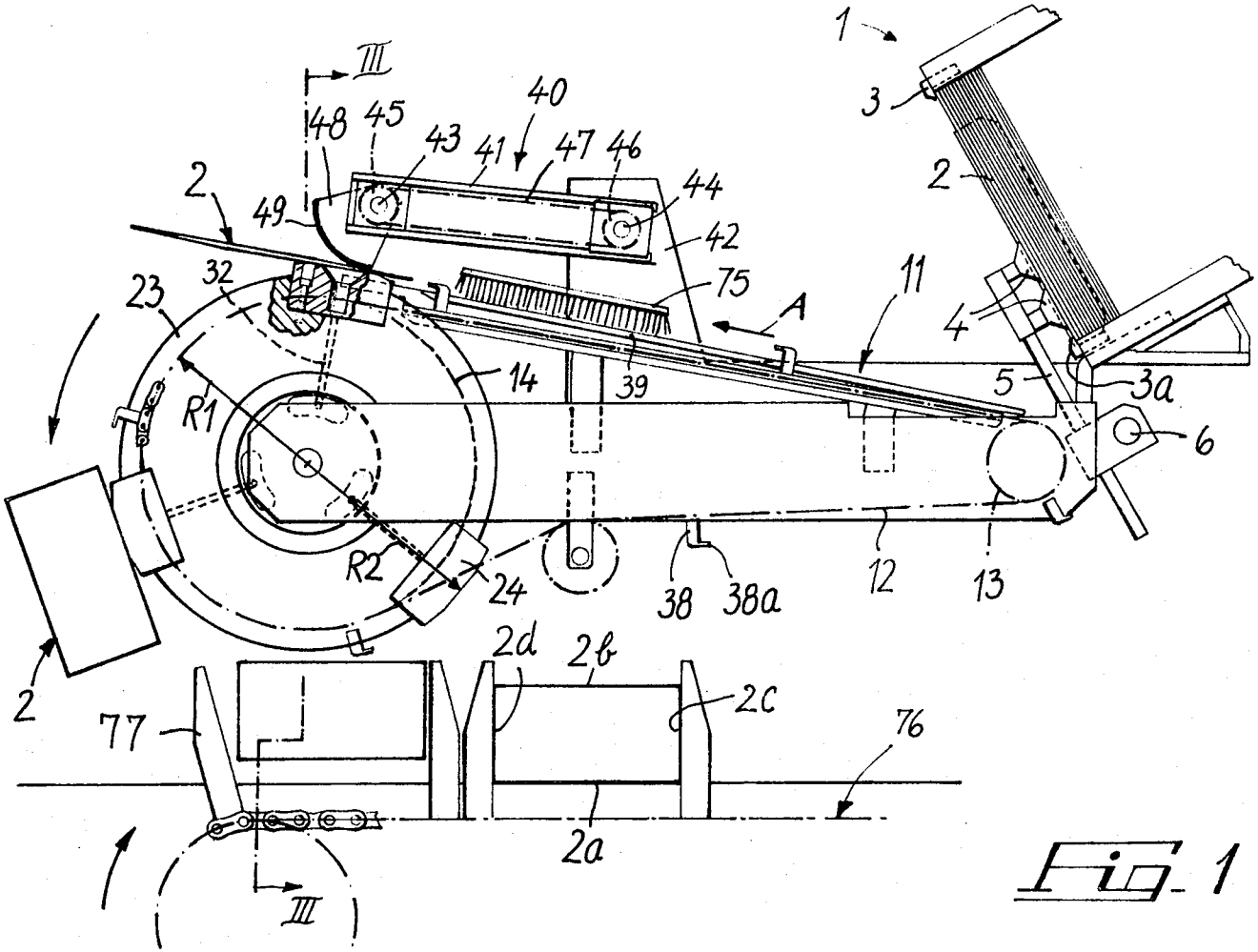
FIG. 1 is a side elevation, partly schematical, view of the machine according to this invention.

In the drawing figures, the reference numeral 1 designates generally a magazine containing a stack of packaging cases 2 in a flattened condition. The cases 2 are tilted forward and retained by grippers 3, 3*a* engaging their top and bottom edges.

Figure 2:
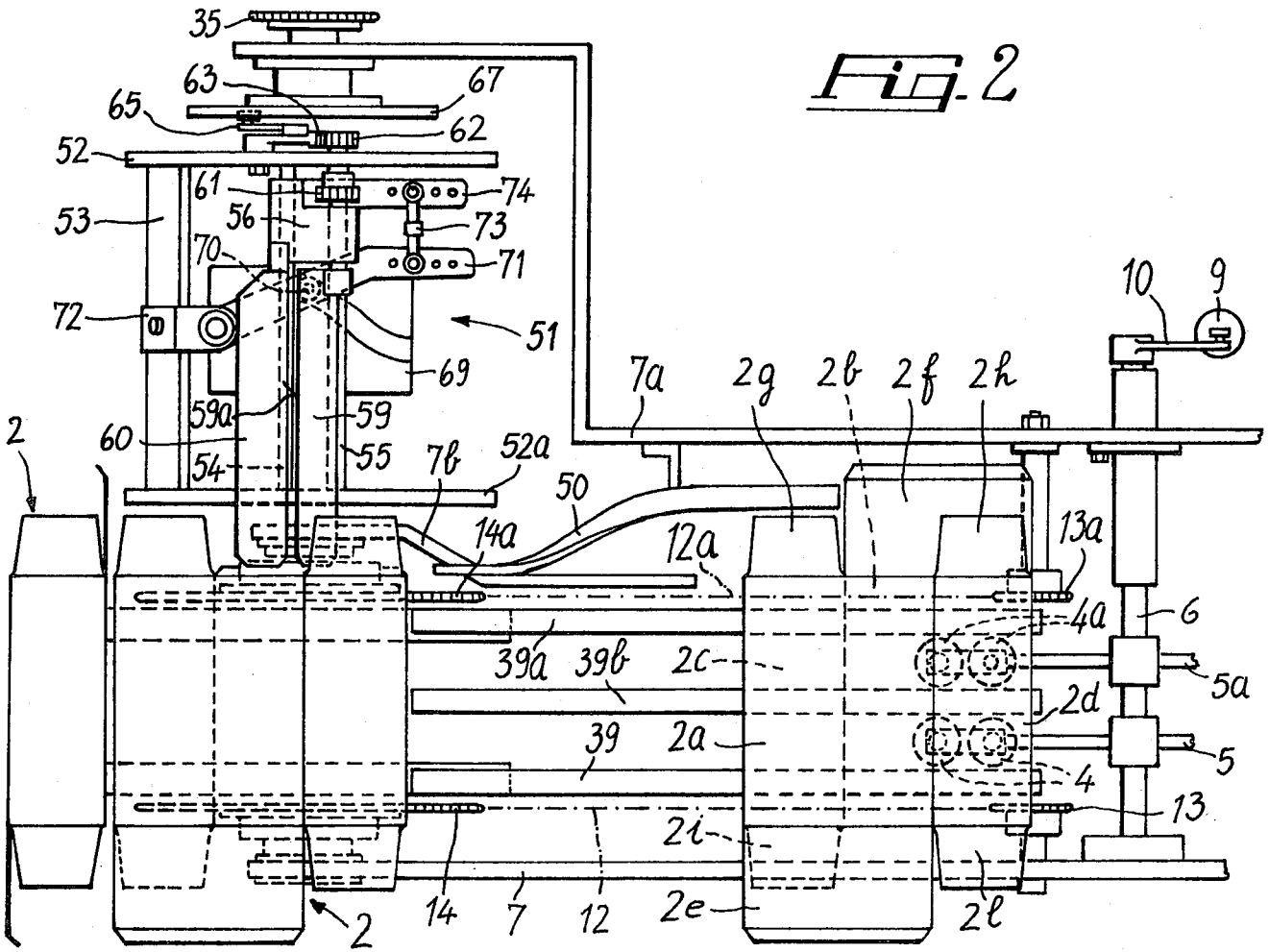
FIG. 2 is a plan view of the same machine.

Each packaging case, as shown in FIG. 2, has four faces 2*a*, 2*b*, 2*c* and 2*d* so dimensioned as to impart a parallelepipedal shape to the case in its spread open condition.

The faces 2*a*,2*b* have larger dimensions than the faces 2*c*,2*d* which, for convenience of discussion, will be termed "sides" hereinafter.

From the opposed ends of the faces 2*a*, 2*b*, there project in a common plane flaps 2*e*,2*f*, which constitute the bottom and cover or lid, respectively, of the packaging case. Additional flaps 2*g*,2*h* and 2*i*,2*l* project from the opposed ends of the flaps 2*c* and 2*d*.

The cases 2 are picked up individually from the magazine 1 by means of pick-up or gripping members comprising two pairs of suckers 4,4*a* mounted on the free ends of related arms 5,5*a* attached to a horizontal shaft 6.

The shaft 6 is carried rotatably in shoulders 7, 7*a* which extend from the bed 8 upwards, and is driven with swinging motion by a jack 9 through a lever 10 keyed to the shaft 6. The amplitude of the oscillations of the shaft 6 is such that the suckers 4,4*a* are moved from a position of engagement with the leading case in the magazine 1 to a position whereat the case is released onto a case transferring conveyor 11. Suitable control members, of conventional design, provide connection of the suckers 4,4*a* to a vacuum pump for enabling the suckers to stick to the case.

Figure 3:
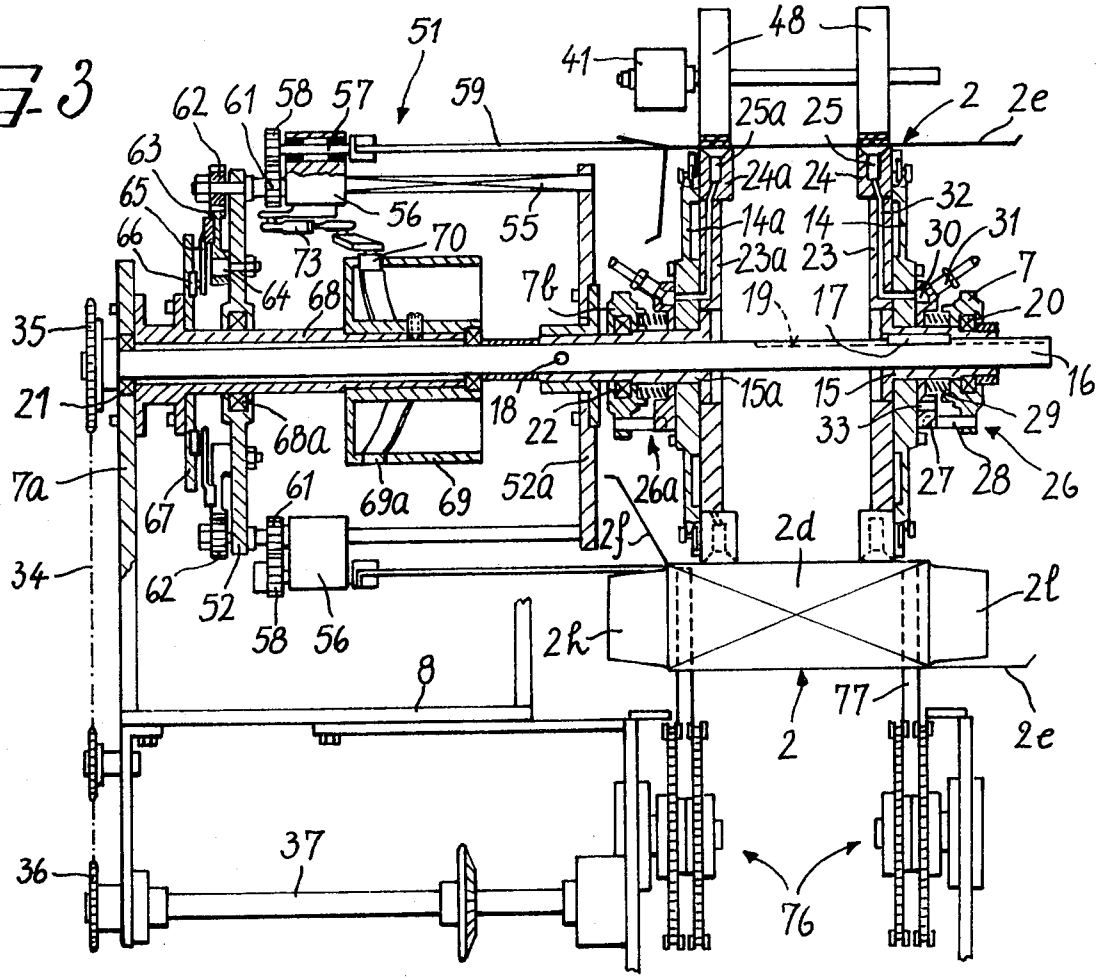
FIG. 3 is a sectional view taken along the line III—III of FIG. 1.
Figure 4:
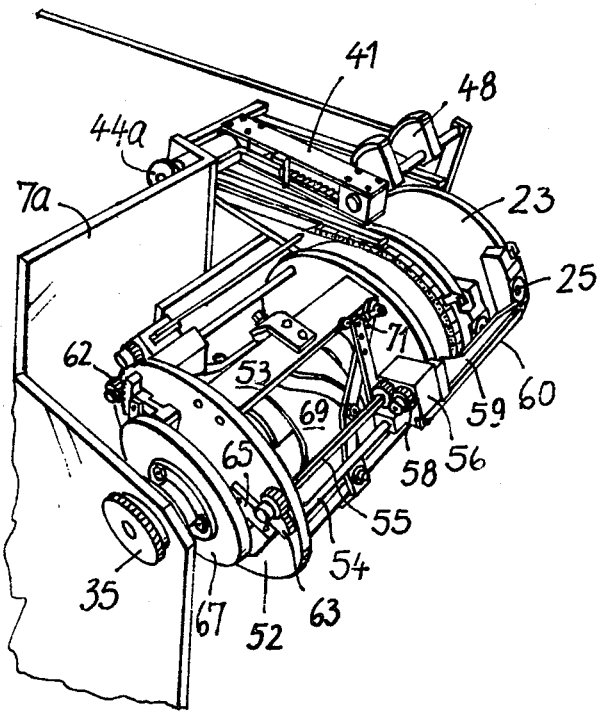
FIG. 4 is a perspective view of the machine shown in the preceding figures.

The conveyor 11 comprises a pair of parallel drive chains 12,12*a* which are passed around sprocket wheels 13,13*a* and 14,14*a*. The sprocket wheels 13, 13*a* are mounted, cantilever-fashion, on the sides 7,7*a* of the machines to be coaxial with each other. The sprocket wheels 14,14*a* are instead attached to sleeves 15,15*a* (FIG. 3) which are made rigid with a horizontal shaft 16 for rotation therewith, as by means of a key 17 and pin 18. The key 17 engages in a keyway 19 axial to the shaft 16, said keyway being extended over a certain distance to allow the spacing of the sprocket wheels 14,14*a* to be varied in accordance with the size of the packaging cases to be processed. The shaft 16 is carried, with the interposition of the sleeves 15,15*a* and, through the bearings 20,21, in the shoulders 7,7*a*, and through the middle bearing 22, in the shoulder 7*b*.

With the sprocket wheels 14,14*a*, there are associated externally disks 23,23*a* which carry, along their peripheries, blocks 24,24*a* which are arranged at equal angles apart to form a rotary body. Said blocks accommodate the suckers 25,25*a* which can be connected to a vacuum pump through respective distributors, generally indicated at 26,26*a*. The distributors are of a conventional type, and for brevity, only the distributor controlling the suckers 25 will be described briefly herein, the other distribution being quite similar. The distributor 26 comprises a disk 27 carried rotatably by the sleeve 15 and blocked against rotation by a small arm 28 attached under the shoulder and engaging a projection of the disk 27. The disk 27 is held pressed against a flat on the wheel 14 (or, alternatively, against a plate rigid therewith) by springs 29 interposed between it and a ring set to rest on the shoulder 7. Through the faces of the disk 27 facing the wheel 14, there is formed a slot 30 which extends concentrically around the shaft 16 and is connected to a vacuum pump through a fitting 31. Conduits 32 formed in the disk 23 and connected to the suckers 25, terminate on the face of the wheel 14 contacting the disk 27 at the slot 30. The slot 30 has such an angular extension as to maintain the connection between the sucker 25 and vacuum pump over a pre-determined angular path, at the end whereof the suckers are deactivated by establishing a connection with the external environment through a hole 33 in the disk 27, as will be apparent hereinafter.

The shaft 16 is driven of continuous motion through a chain 34 engaging a sprocket wheel 35 keyed to that end of the shaft 16 which is external to the shoulder 7*a*. The chain is passed as a closed loop around a sprocket pinion 36 keyed to a driveshaft 37.

As can be seen more clearly in FIG. 1, the chains 12,12*a* are provided with entrainment pushers 38, formed with bills 38*a* imparting a hooked shape thereto for engagement with the trailing edges of the cases, which the suckers 4,4*a* have deposited onto sliding surfaces 39, 39*a*, 39*b* located between the upper runs of the chains. Said upper runs follow a path which slopes slightly upwards over the horizontal in the direction of advance A thereof. It should be noted that the radii R1 of the sprocket wheels 14,14*a* are smaller than the radii R2 of the outer faces of the blocks 24,24*a*. To allow the flattened cases to raise to contact the blocks 24,24*a* in order to be picked up at the bottom by the suckers 25,25*a*, provision is made for the sliding movement surfaces 39,39*a*,39*b* to slope slightly upwards with respect to the chains 12,12*a*. The difference between the radii R1 and R2 is justified by the need of withdrawing the trailing edges of the cases from under the bills 38*a* of the entrainers prior to spreading them open. This withdrawal is effected in that the case, once it has moved onto the blocks 24,24*a*, is at a larger radius, thereby, for a given angular displacement, it covers a longer distance than the chains, thus moving away from its related entrainers.

To provide a more effective retentive action by the suckers, a pusher device 40 (FIG. 1) is arranged to overlie the conveyor 11 and is effective to press the cases against the suckers until the latter have fully engaged the cases. The device 40 comprises an arm 41 which protrudes from an upright 42 rigid with the shoulder 7*a* and carries rotatably a pair of small shafts 43,44, whereto are keyed respective cog pulleys 45,46. Around said pulleys, a cogged belt 47 is passed, and to the shaft 43 are keyed two cylindrical sectors 48 which are coated, over their circular contours, with a layer 49 of rubber or the like material. The shaft 44 has one end extended beyond the upright 42, whereto a gear wheel 44*a* is keyed which is connected to the main drive to impart to the sectors 48 such a rotational movement in the direction B, that their peripheral speed is equal to that of the blocks 24,24*a*. Furthermore, the rotational movement of the sectors 48 is synchronized with that of the disks 23,23*a* such that, at each revolution, the pushers are caused to roll over the blocks 24,24*a*.

While the flattened cases 2, as picked up from the magazine 1, are being moved along their path between the wheels 13,13*a* and wheels 14,14*a*, a specially provided folder 50 (FIG 2.) tilts the cover or lid 2*f* downwards, to a vertical position. The folder 50 comprises a strip attached to the shoulder 7*a* and extending, with a first portion, parallel to the upper run of the chain 12*a* at a height above the cover 2*f*.

The strip 50 is then threaded in, to force the cover 2*f* to fold downwards and take in practice a substantially vertical lay, perpendicularly to the faces 2*b* and 2*c* of the case. The downward folding of the cover 2*f* is intended to allow the operation of the case spreading devices, as generally indicated at 51. That device comprises a pair of circular disks 52,52*a* which are interconnected by crossmembers 53 which are distributed angularly. Between the crossmembers 53 and parallel thereto, there extend pairs of rods 54,55, the rods 54 having their opposed ends fixed to the disks 52,52*a*, and the rods 55 having a square cross-sectional configuration and pivotally supported on the disks themselves.

Each rod pair 54,55 is arranged to guide a carriage 56, whereon a pin 57 is carried pivotally which has its rotation axis parallel to the guiding rods 54,55.

The pin 57 carries at one end a pinion gear 58, and at the other end a blade or spade 59 which is flattened and tapered at its free end. The blade 59 is parallel to the pin 57 and offset mounted thereon. The width of the blade 59, that is the distance between its edge 59*a* and the rotation axis of the pin 57, is related to the width of the flap 2*d*. In fact, and as will be explained hereinafter, the blade 59 is intended for penetrating the closed case, and by rotation of the pin 57, for lifting the flap 2*d*, thus causing the case to open. On the carriage 56, on one side of the pivotable blade 59, a second blade 60 is attached which has the function, also be penetrating the case simultaneously with the blade 59, of holding the lower face depressed while the other blade is opening the case.

The rotation of the pin 57 is determined by a gear wheel 61 meshing with the pinion gear 58, which gear wheel is carried rotatably by the carriage 56 such as to be rotatively coupled to, but axially slidable along, the rod 55.

To the rod 55, on the outer side of the disks 52, there is secured an additional gear wheel 62 which meshes internally with a gear sector 63 articulated to the disk 52 by means of a pivot pin 64. The gear sector or segment 63 is also provided with an arm 65 to the end whereof is attached a cam follower 66 in constant engagement in a groove of a radial cam 67 which is flange connected to a sleeve 68 covering the shaft 16 outside. The sleeve 68 is attached to the shoulder 7*a* and forms the support for the disk 52, with the interposition of rolling means 68*a*.

To control the reciprocating movement of the carriage 56 along the rods 54,55, there is provided a drum type of axial cam 69 which is attached to the sleeve 68 and located between the disks 52 and 52*a*. On the axial cam 69, there is formed peripherally a groove 69*a* of closed loop configuration around the shaft 16 and following a substantially sinusoidal path wherealong it engages a cam follower 70. The latter is mounted at a middle position on a lever 71 which is articulated to an angle sectional member 72 secured to the crossmember 53. The end of the lever 71 is connected, through a linkage 73, to an arm 74 rigid with the carriage 56.

The machine described in the foregoing operates as follows.

A case, as picked up from the magazine 1 by the suckers 4,4*a*, is deposited, in suitably timed relationship with the advance movement of the chains 12,12*a*, onto the chains themselves and engaged at the rear by the entrainers 38, which transfer it to the area of engagement with the suckers 25,25*a*. During its travel, the case is suitably held against the intermediate surface of sliding movement, 39*b*, by a brush 75 whereunder it is caused to pass. Upon reaching the blocks 24,24*a*, the case is pressed by the sectors 48 onto the suckers 25,25*a*, which when activated will retain it for the subsequent processing. It should be noted that, as previously mentioned, the cover or lid 2*f* is now upside down, and that the rear or trailing edge of the case, on which the pushers 38 were active, has now moved out from under the bills 38*a* owing to the speed differential existing between the chains 12,12*a* and the blocks 24,24*a*.

As the case assumes an almost horizontal lay at the top of the disks 23,23*a*, the corresponding carriage 56 begins to move, which carriage, under control by the cam 69 and through the linkage 71,73,74, will move from the disk 52 toward the disk 52*a*, thus allowing the blades 59,59*a* to penetrate the case.

After the blades have moved into the case, the blade 59 is rotated, as determined by the oscillation of the gear sector 63 under control by the cam 67 and through the arm 65. In fact, the sector 63 will impart to the pin 57, through the gears 62,61,58, an angular movement of 90° which causes the blade to arrange itself perpendicularly to its former coplanarity with the case. That rotation causes the side 2*d* to lift and arrange itself normal to the face 2*b*, thereby the case expands to take its parallelepipedal shape. The blade 59 will retain its orientation over about 180°, to be withdrawn prior to the delivery of the opened case, by deactivation of the suckers 25,25*a*, onto a removal conveyor 76 where the cases are held between teeth 77.

It will be appreciated that the invention fully achieves its objects. In particular, it should be noted that during the rotation of the blade 59, the blade 60 is held against the face 2*b* to prevent it from raising. This is important especially in spreading open cases of large size, where a quick raise of the side 2*d* could produce an excessive low pressure within the case and objectionable deformation of the same. In the machine according to this invention, the case opening action occurs positively, and the forces applied are made to act on large surface areas, thus ensuring the capability of handling large size cases and cases made of inferior strength materials.

In practicing the invention, several modifications and variations may be introduced without departing from the invention scope. Thus, for example, those suckers which grip the lower or bottom face of the cases, instead of following a circular path, may follow a rectilinear path if mounted on a flexible member of the type of a chain or the like. Consequently, the case opening blades would also move along a rectilinear path, to follow, at least over a sufficient distance to enter the cases, said gripping members.

I claim:

1. An automatic machine for opening packaging cases having an erected parallelepipedal configuration comprising a magazine containing a stack of said cases in a tubular flattened condition, means for picking up individual cases from said stack, a transferring conveyor whereon said picked up cases are deposited and engaged for advance by entraining means arranged on said conveyor, a rotary body provided with at least a peripherical sucker operable to hold a flattened case transferred thereon by said conveyor transversally with respect to the direction of rotation of said body, said machine further comprising a pair of disks interconnected by crossmembers and coaxially connected to said body, guiding rods extending between said disks and parallel to the axis of rotation thereof, a carriage mounted to slide on said rods, a blade element pivotally mounted on said carriage for rotation about an axis parallel to said rods and in alignment with said flattened case held on said sucker, means for moving said carriage back and forth along said rods so as to reciprocate said blade between a first position external to said case and a second position in the inside thereof, means being also provided for rotating said blade element within said case thus causing said case to open.

2. A machine according to claim 1, wherein said means for moving said carriage comprise a stationary drum cam coaxial to the rotation axis of said disks, a lever having one end articulated to said cross members and the opposite end articulately connected to said carriage, said lever having a cam follower in engagement with said drum cam.

3. A machine according to claim 1, wherein said means for rotating said blade element comprise a radial cam, coaxial to the rotation axis of said plates and arranged near one disk of said pair, a gear sector articulated to said one disk and having a cam follower in engagement with said radial cam, a rod rotatively supported on said disks, a gear wheel rigid on said rod and meshing with said articulated sector, an additional gear wheel rotatively coupled, but axially slidable on said rod, a pin rotatively supported on said carriage and a pinion gear keyed on said pin and meshing with said additional gear wheel, said blade element being connected to said pin in parallel alignment.

4. A machine according to claim 1 and further comprising a second blade attached on the carriage and extending parallel to said pivotable blade element to penetrate and hold the case while the blade element rotates.

* * * * *